US008777432B2

(12) United States Patent
Mayer

(10) Patent No.: US 8,777,432 B2
(45) Date of Patent: Jul. 15, 2014

(54) DISPLAY DEVICE HAVING AN OPTICAL DISPLAY FIELD

(75) Inventor: Michael Mayer, Oberasbach (DE)

(73) Assignee: Siemens Aktiengesellschaft, Munich (DE)

( * ) Notice: Subject to any disclaimer, the term of this patent is extended or adjusted under 35 U.S.C. 154(b) by 38 days.

(21) Appl. No.: 13/548,741

(22) Filed: Jul. 13, 2012

(65) Prior Publication Data

US 2013/0027925 A1 Jan. 31, 2013

(30) Foreign Application Priority Data

Jul. 27, 2011 (EP) ..... 11175552

(51) Int. Cl.
*F21V 19/04* (2006.01)

(52) U.S. Cl.
USPC ..... 362/20; 315/297

(58) Field of Classification Search
USPC ..... 362/20, 23.01, 23.04, 23.05, 23.07, 362/23.1, 23.11
See application file for complete search history.

(56) References Cited

U.S. PATENT DOCUMENTS 6,210,010 B1 * 4/2001 Pontetti et al. ..... 362/24
7,710,253 B1 * 5/2010 Fredricks ..... 340/464
2011/0175952 A1 7/2011 Nabesawa et al.

FOREIGN PATENT DOCUMENTS

DE 10 2009 031403 1/2011
EP 2 337 430 6/2011

* cited by examiner

*Primary Examiner* — Donald Raleigh
(74) *Attorney, Agent, or Firm* — Cozen O'Connor

(57) ABSTRACT

A first light source arranged behind a display field and configured to generate an elementary color or a secondary color from red, green and blue elementary colors for increasing safety of a display device having an optical display field, wherein the first light source is connected to an activation module which is configured to activate the first light source based on the desired color. A second light source is arranged behind the display field and configured to generate the elementary color or the secondary color from the red, green and blue elementary colors. The second light source is connected to the activation module which is configured to activate the second light source based on the desired color of the first light source, and a monitor is provided which is configured to identify an error or a fault on one of the light sources and to shutdown the faulty light source.

10 Claims, 2 Drawing Sheets

DISPLAY DEVICE HAVING AN OPTICAL DISPLAY FIELD

BACKGROUND OF THE INVENTION

1. Field of the Invention

The invention relates to a display device having an optical display field in which a first light source is arranged behind the display field, where the light source is configured so as to generate an elementary color or a secondary color from the elementary colors red, green and blue, and where the first light source is connected to an activation module and the activation module is configured to activate the first light source in accordance with the color to be generated.

2. Description of the Related Art

Display devices are preferably used in automation technology to automate industrial processes. Here, the display devices are preferably configured as control and observation devices or Human Machine Interface (HMI) devices. Furthermore, the display devices can be embodied as key panels or pushbutton panels. The key panels or pushbutton panels generally comprise illuminated push-buttons for machine operation. These display devices and/or panels are preferably designed for direct machine operation. As a result, they are preferably connected to a programmable logic controller by a field bus, such as a Profibus or a Profinet. Display devices of this type are essentially used to relay a machine status in the form of color information and to receive information in the form of pushed or keyed buttons on the display device.

With buttons that are configured as illuminated pushbuttons, the five colors red/green/blue/yellow/white can preferably be represented on account of the RGB LED used. In this way, yellow and white represent secondary colors. Yellow is produced from red and green, white is produced from red and green and blue.

If a fault occurs on one of the LEDs, the color information to be reproduced is distorted. The user or a machine operator may then interpret the machine status incorrectly. Particularly in automation technology, i.e., in safety-oriented automation technology, the color information yellow is interpreted as an abnormal status (also see International Electrotechnical Commission/European (IEC/EN) standard 60204-1.

SUMMARY OF THE INVENTION

It is therefore an object of the invention to provide a display device for representing color information, which increases the safety in automation technology.

This and other objects are advantages are achieved in accordance with the invention by a display device in which a second light source is arranged behind the display field, which is likewise configured so as to generate an elementary color or a secondary color from the elementary colors red, green and blue, where the second light source is connected to an activation module and the activation module is configured to activate a second light source in accordance with the color of a first light source to be generated, and where a monitoring device is present, which is configured to identify an error or a fault on one of the two light sources, and thereupon to shut down the faulty light source.

An illumination redundancy is ensured because individual display fields in a display device are now illuminated with two independent light sources. Consequently, if a total failure occurs in one of the light sources, then the display field can also be illuminated with the other light source in each instance. If an error occurs in one of the light sources, which manifests itself such that a reliable representation of an elementary color or a secondary color is no longer ensured, the color information to be reproduced can be distorted. The particular problem here is a color change from yellow to green. RGB light sources mix the color yellow from the colors red and green. The color information yellow is evaluated as safety-critical color information, because yellow represents an abnormal status.

If the light source component for the red color now fails in one of the RGB light sources, then the entire color information is distorted. With preferably a parallel circuit of the two RGB light sources, a new secondary color would in turn result, because a light source still illuminates yellow and the other light source illuminates green on account of red failing, this new secondary color is however highly influenced by the color green. Green light is, however, in turn interpreted in automation technology as a normal status. To ensure that failure of a color component of an RGB light source does not result in incorrect information, this error is identified in accordance with the invention and the faulty light source is thereupon shut down. Reproduction of the color information that is actually relevant, preferably yellow, is therefore ensured.

In a further embodiment, the activation module comprises a first output, a second output and a third output for the first light source and a fourth output, a fifth output and a sixth output for the second light source. Three outputs are therefore available for each of the two redundantly connected light sources. Each output preferably controls a color component, i.e., the first output controls the color component red, the second output controls the color component green and the third output controls the color component blue. The same applies accordingly to the fourth to sixth output of the second light source.

In order to optimize error detection, the activation module also comprises a device for identifying a short circuit and/or a another device for identifying a broken wire with respect to the light sources.

The reliability of a display device is further increased in another embodiment by an indicator. To this end, the activation module comprises an indicator that is configured to indicate the identified error to a superordinate module.

The indicator is advantageously connected to a control module and the control module with the indication means form the monitoring device.

For use in an automation environment, the display device comprises a field bus interface for connection to a programmable logic controller. Here the control module is preferably connected to the field bus interface to forward an error message to a programmable logic controller.

In one embodiment, the display device comprises a pushbutton that includes the display field.

Each light source is advantageously configured as an RGB LED.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The drawings indicate an exemplary embodiment and are to explain the invention in more detail, in which.

DETAILED DESCRIPTION OF THE PREFERRED EMBODIMENTS

Figure 1:
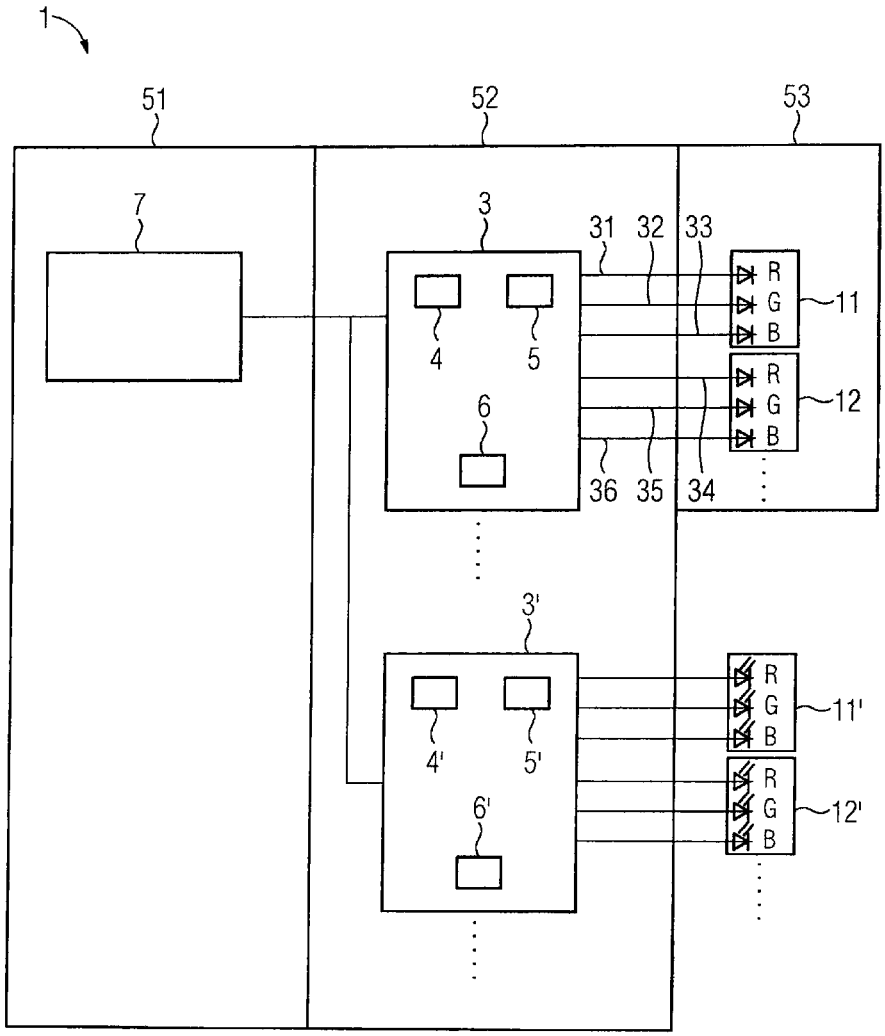
FIG. 1 shows a schematic block diagram of the display device having a redundancy component, a monitoring component and a control component in accordance with the invention.

With specific reference to FIG. 1, shown therein is a schematic block diagram of a display device 1 having a control component 51, a monitoring component 52 and a redundancy component 53. The redundancy component 53 essentially comprises a first light source 11 and a second light source 12 for redundantly illuminating a display field 2 (see FIG. 2). Indicating points arranged vertically one below the other shows that a display device 1 can comprise a plurality of optical display fields 2. This is clarified with the representation of a further first light source 11' and a further second light source 12'.

The first light source 11 and the second light source 12 are connected to an activation module 3. The activation module 3 is configured to activate the first light source 11 via a first output 31 (red), a second output 32 (green) and a third output 33 (blue) in accordance with the color to be reproduced. The representation of the color yellow is particularly critical, in which the first output 31 and the second output 32 are controlled by the activation module 3. The redundant second light source 12 is likewise configured to generate an elementary color or a secondary color from the elementary colors red, green and blue. In this way, the second light source 12 is connected to the activation module 3 by a fourth output 34 (red), a fifth output 35 (green) and a sixth output 36 (blue). Here, the activation module 3 is configured to likewise activate the second light source 12 in accordance with the color of the first light source 11, in other words yellow, to be generated, such that the fourth output 34 and the fifth output 35 are active.

The first light source 11 and the second light source 12 are each configured as an RGB LED. In order to identify an error or a fault on either one of the first and second light sources 11, 12, the activation module 3 comprises a device 4 for identifying a short circuit and another device 5 for identifying a broken wire. If a short circuit or a broken wire is identified in the RBG LED, the devices 4, 5, then accordingly pass on the identified error to an indication means 6. In one variant, the activation module 3 could operate independently, in which case the activation module 3 is configured to shut down the faulty light source after identifying a short circuit or broken wire and the shutdown is implemented immediately after occurrence of an error.

In another embodiment, a monitoring device provides the command to shut down the light source. In this way, the indicator 6 indicates an error to a control module 7 and the control module 7 gives the command for shutdown to the activation module 3.

A conceivable error would be that with the second light source 12, either a light-emitting diode for the color component red is faulty or the line between the fourth output 34 and the second light source 12 is broken. This error means that the red component of the second light source 12 is no longer active and only green light is now sent from the second light source 12. The first light source 11 and the second light source 12 normally operate in redundant operation. As a result, an incorrect color is therefore represented. This incorrect color is a new secondary color, because the first light source 11 illuminates toward yellow and the second light source 12 illuminates green on account of red failure, this new secondary color however is very heavily influenced by the color green. The evaluation of the color yellow indicates an abnormal state in automation technology. Consequently, this abnormal state can no longer be reliably indicated, for which reason the second light source 12 is completely shut down by the activation module 3 triggered by the control module 7.

This shutdown and/or generally the identification of an error on either one of the first and second light sources 11, 12 is routed to the control module 7. In this way, the control module 7 is configured, in addition to outputting shutdown commands, to assume the control and monitoring of all components needed for the display device.

Figure 2:
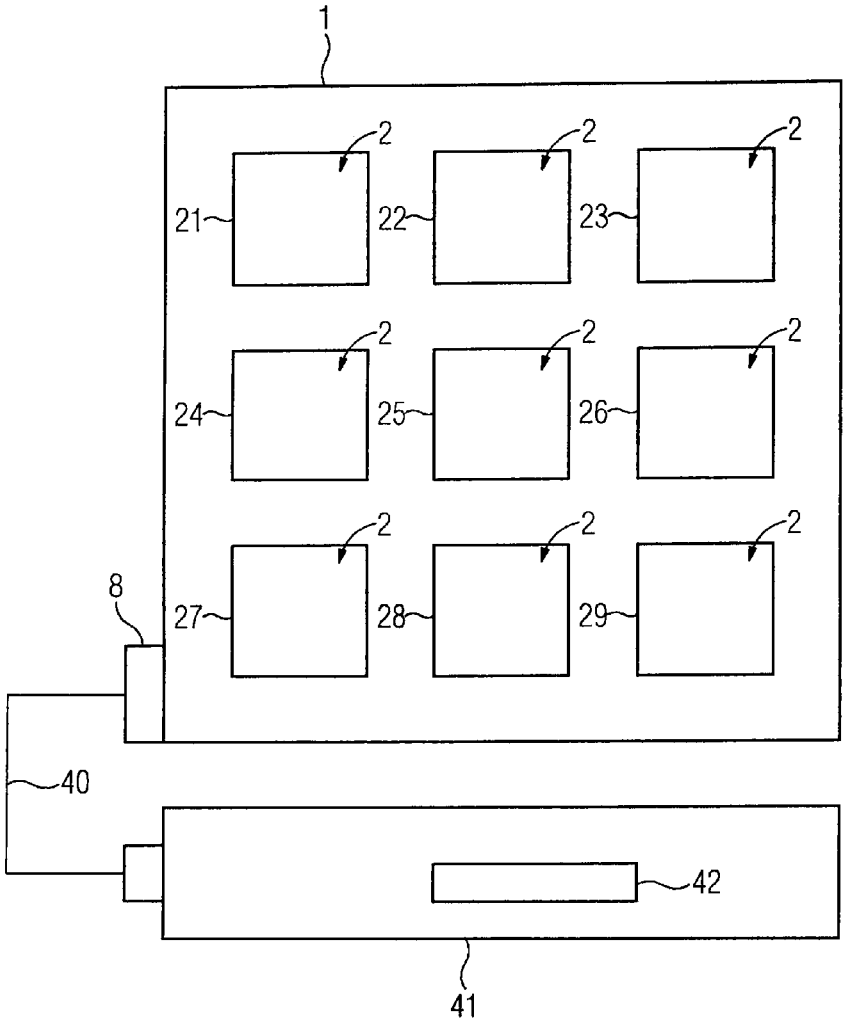
FIG. 2 shows a display device of FIG. 1 having an arrangement of pushbuttons, where the display device is connected to a programmable logic controller.

With reference to FIG. 2, shown therein is a display device with nine pushbuttons, i.e., a first pushbutton 21 up to a ninth pushbutton 29. Each of the pushbuttons 21 to 29 is provided with a display field 2. The light sources described in FIG. 1 are arranged redundantly behind the display field 2.

Based on the structure of the display device 1 of FIG. 1, the display device 1 from FIG. 2 now also comprises a field bus interface 8. This field bus interface 8 connects the display device 1 to a programmable logic controller 41 over a field bus 40. In this way, the control module 7 within the display device 1 is also connected to the field bus interface 8 and configured such that an error message relating to the light sources is routed to the field bus interface 8 and this error message can therefore reach the programmable logic controller 41 over the field bus 40 and as a fault indication can inform a user or a machine operator of the failure of a light source.

A machine operator may possibly identify the failure of an LED on the display device from the outside, because the faulty RGB LED is now shut down to prevent incorrect color information from being relayed, but the other RGB LED, which is not affected by the errors, continues to illuminate and contains the color information of the respective pushbutton; only the brightness of the color information of the pushbutton is negatively affected.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A Human Machine Interface (HMI) device for connection to a programmable logic controller, comprising:

a field bus interface connected to the programmable logic controller;

an optical display field;

a first light source arranged behind the optical display field of the HMI device and configured to generate a color to be generated as one of (i) an elementary color or (ii) a secondary color from elementary colors comprising red, green and blue;

an activation module connected to the first light source of the HMI device and configured to activate the first light source in accordance with the color to be generated;

a second light source arranged behind the optical display field of the HMI device and configured to generate the color to be generated, the second light source being connected to the activation module and the activation module of the HMI device being further configured to activate the second light source in accordance with the color to be generated; and a monitor configured to identify one of (i) an error and (ii) a fault on one of the first and second light sources and thereupon to shut down a faulty light source of the first and second light sources.

2. The Human Machine Interface device as claimed in claim 1, wherein the activation module comprises a first output, a second output and a third output for the first light source and a fourth output, a fifth output and a sixth output for the second light source.

3. The Human Machine Interface device as claimed in claim 1, wherein the activation module device comprises a device for identifying a short circuit with respect to the first and second light sources.

4. The Human Machine Interface device as claimed in claim 2, wherein the activation module device comprises a device for identifying a short circuit with respect to the light sources.

5. The Human Machine Interface device as claimed in claim 1, wherein the activation module comprises a further device for identifying a broken wire with respect to the first and second light sources.

6. The Human Machine Interface device as claimed in claim 3, wherein the activation module comprises a further device for identifying a broken wire with respect to the first and second light sources.

7. The Human Machine Interface device as claimed in 1, wherein the activation module comprises an indicator configured to indicate the identified one of the error and a fault to a superordinate module.

8. The Human Machine Interface device as claimed in claim 7, wherein the indicator is connected to a control module, and the control module together with the indication means form the monitor.

9. The Human Machine Interface device as claimed in claim 1, further comprising:

a pushbutton which includes the display field.

10. The Human Machine Interface device as claimed in claim 1, wherein each of the first and second light sources comprises an RGB LED.

* * * * *